US007895907B2

(12) United States Patent
Thumer et al.

(10) Patent No.: US 7,895,907 B2
(45) Date of Patent: Mar. 1, 2011

(54) METHOD OF MEASURING THE TENSILE STRESSING OF A MOVING WEB

(75) Inventors: Frank Thumer, Augsburg (DE); Hans-Richard Seibold, Diedorf (DE); Rudolf Werber, Königsbrunn (DE); Tobias Hain, Augsburg (DE)

(73) Assignee: Texmag GmbH Vertriebsgesellschaft, Thalwil (CH)

( * ) Notice: Subject to any disclaimer, the term of this patent is extended or adjusted under 35 U.S.C. 154(b) by 229 days.

(21) Appl. No.: 12/308,348

(22) PCT Filed: Dec. 14, 2007

(86) PCT No.: PCT/EP2007/010991

§ 371 (c)(1),
(2), (4) Date: Dec. 12, 2008

(87) PCT Pub. No.: WO2008/071436

PCT Pub. Date: Jun. 19, 2008

(65) Prior Publication Data

US 2009/0288500 A1 Nov. 26, 2009

(30) Foreign Application Priority Data

Dec. 15, 2006 (EP) ..... 06026051

(51) Int. Cl.
*G01L 1/26* (2006.01)

(52) U.S. Cl. ..... 73/862.391; 73/159

(58) Field of Classification Search ..... 73/862.381–862.391, 159
See application file for complete search history.

(56) References Cited

U.S. PATENT DOCUMENTS

| | | | | |
|---|---|---|---|---|
| 3,828,435 | A * | 8/1974 | Baker | 33/1 H |
| 4,130,014 | A * | 12/1978 | Eddens | 73/862.474 |
| 4,765,188 | A * | 8/1988 | Krechmery et al. | 73/708 |
| 4,766,763 | A * | 8/1988 | Kurtz | 73/49.2 |
| 6,532,830 | B1 * | 3/2003 | Jansen et al. | 73/862.042 |
| 6,834,538 | B2 * | 12/2004 | Kiess et al. | 73/114.19 |
| 7,030,601 | B2 * | 4/2006 | Buchhold | 324/117 R |

FOREIGN PATENT DOCUMENTS

| | | |
|---|---|---|
| DE | 101 18 887 C1 | 8/2002 |
| EP | 0582947 A1 | 2/1994 |
| GB | 600 085 A | 3/1948 |

* cited by examiner

*Primary Examiner* — Max Noori
(74) *Attorney, Agent, or Firm* — Robert L. Epstein; Epstein Drangel LLP

(57) ABSTRACT

In a method for measuring the tensile stress of a running web, force sensors (7) are connected in the form of a Wheatstone bridge (11). An amplifier (18) amplifies a diagonal voltage (17) of the Wheatstone bridge (11). In order to be able to detect whether at least one of the force sensors (7) is defective, the Wheatstone bridge (11) can be loaded using at least one resistor (26) by means of at least one switch (24, 25). Comparing the measured values, with loading, with the measured values, without loading, determines whether the force sensors (7) of the Wheatstone bridge (11) are functional. Otherwise, an active error signal (28) is output.

15 Claims, 3 Drawing Sheets

METHOD OF MEASURING THE TENSILE STRESSING OF A MOVING WEB

Figure 1:
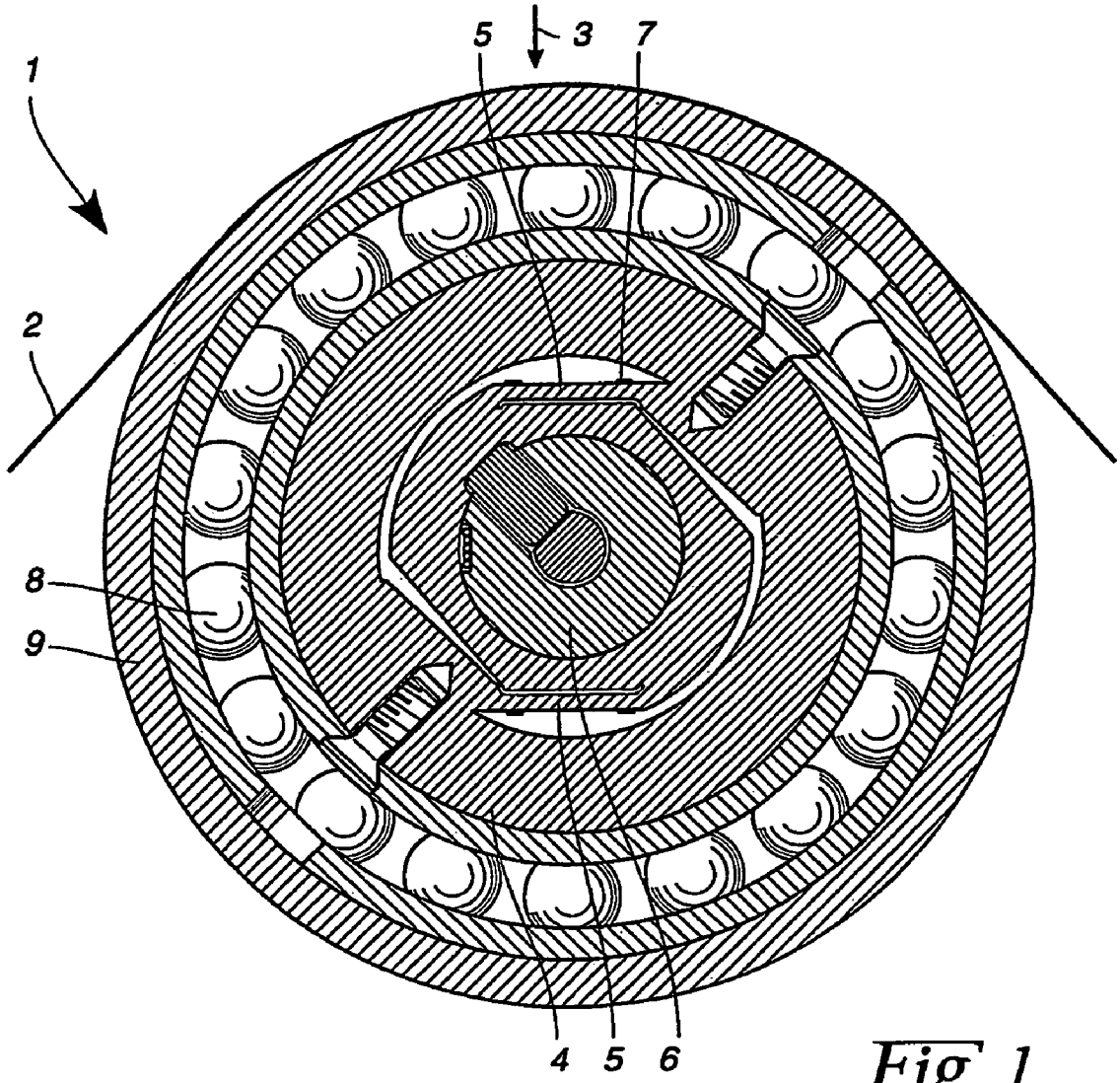

The invention relates to a method for measuring the tensile stress of a running web according to the precharacterizing clause of Patent Claim 1.

DE 101 18 887 C1 discloses an apparatus for detecting the tension force of a running material web, said apparatus detecting the bearing force of a roll which deflects the web. For this purpose, this apparatus has two double bending bars which are fitted with force sensors in the form of strain gauges. These strain gauges are connected in the form of a Wheatstone bridge in order to achieve the lowest possible temperature dependence and drift of the sensor. This sensor has proved itself well in practice and forms the starting point of the present invention. The disadvantage of this known sensor has been found to be that, in the event of failure of the strain gauges, for example as a result of fracture or a short circuit, the entire sensor provides nonsensical values which are then interpreted in a corresponding manner by downstream units. If the sensor is contained, for example, in the control loop of a web tension regulating means, the regulating operation may completely eliminate the web tension or may significantly overstretch the running web, depending on the type of failure. In the simplest case, this may result in the web tearing if the web can no longer withstand the tension introduced or gets caught on account of the lack of tension in parts of the machine. When regulating endless belts in paper machines, in particular, this may even result in rolls being torn from their bearings and thus in people and machines being in considerable danger.

The invention is based on the object of providing a method for measuring the tensile stress of a running web of the type mentioned initially, which method can also detect the failure of electronic components and can react to it in an appropriate manner.

According to the invention, this object is achieved by means of the features of Patent Claim 1.

The method according to Claim 1 is used to measure the tensile stress of a running web using a sensor. In this case, it is not important whether the web is in the form of an intrinsically closed web or a continuous web. The material of the running web is not important either for use of this method. The sensor has a Wheatstone bridge containing at least one force sensor. Different sensor principles which are capable of converting a force or a mechanical deformation into an electrical signal are suitable as force sensors. Strain gauges which are placed onto a mechanical component, for example a double bending bar, which is deformed by the action of the force to be measured, are preferably used as the force sensors. In this case, it is sufficient, in principle, for only one resistor of the Wheatstone bridge to be in the form of a force sensor. However, all of the resistors of the Wheatstone bridge are preferably in the form of force sensors in order to achieve the lowest possible temperature dependence and drift of the sensor. The diagonal voltage of the Wheatstone bridge is a measure of the acting force. This diagonal voltage is amplified by an amplifier which mainly has the task of keeping resistive loads, which could corrupt the measurement result, away from the Wheatstone bridge. In addition, the amplifier may also amplify the voltage in order to bring the measurement signal to a voltage range which can be easily processed. However, this is not absolutely necessary and depends, in particular, on the specific choice of force sensors. This amplifier emits, at its output, a signal which, apart from an offset which may need to be taken into account, is proportional to the tensile stress measured and is referred to below as a tensile stress signal. If one of the force sensors fails, this results in a short circuit or in an interruption inside the Wheatstone bridge, depending on the cause of the defect. At any rate, this greatly corrupts the tensile stress signal, with the result that it can no longer be used for display or regulation purposes. In order to be able to detect such a defect inside the sensor and react to it in an appropriate manner, an error signal is output in addition to the tensile stress signal. This error signal is inactive during normal operation and is changed to an active state in the event of the occurrence of a detectable error inside the sensor. In order to be able to detect an error inside the sensor, the Wheatstone bridge is periodically loaded by at least one resistor using at least one intermittently driven switch during loading by the tensile stress of the running web. This loading resistor detunes the Wheatstone bridge in a defined manner, the effect of this loading being able to be directly determined by comparing the tensile stress signal with resistive loading and the tensile stress signal without resistive loading. This test is carried out during operation of the sensor which is loaded by the web, with the result that the functionality of said sensor is checked in real time. In the event of one of the force sensors of the loaded voltage divider having an internal short circuit, it will be determined that the tensile stress signal is not changed by the loading of this voltage divider. The same applies to the situation in which the force sensor connected in series with the loading resistor has an interruption. If the force sensor connected in parallel with the loading resistor has an interruption, there is certainly dependence of the tensile stress signal on the loading but it is twice as high as in the case of the functioning sensor. The dependence of the tensile stress signal on the loading can thus be used to clearly check whether the sensor is still functional. Drifts of the force sensors may also be detected within certain limits. The error signal is then activated or deactivated according to the result of this test. Downstream components, such as displays or regulators, may be informed of the erroneous nature of the measurement signal by additionally outputting this error signal. When an active error signal is received, the downstream components which are intended to evaluate the tensile stress signal can then be changed over into a mode in which they no longer evaluate the tensile stress signal, thus avoiding damage to people and machines.

The loading test of only one voltage divider in order to determine the functionality of the sensor is inadequate, in particular in cases in which both voltage divider branches of the Wheatstone bridge have at least one force sensor. In this case, it is favourable according to Claim 2 if both output lines of the Wheatstone bridge are loaded with at least one resistor by means of at least one switch. The resistance values of all active elements of the Wheatstone bridge can thus be checked. An active error signal is preferably output if any active element inside the Wheatstone bridge fails.

In order to be able to reliably detect all defects inside the sensor, it is advantageous according to Claim 3 if the two output lines of the Wheatstone bridge are alternately loaded by the at least one resistor. As a result, even cases in which two force sensors are simultaneously defective are reliably detected by the two loading tests to be carried out.

In order to achieve error analysis which is as meaningful as possible, it is favourable according to Claim 4 if the difference between the tensile stress signals with and without loading of the Wheatstone bridge is calculated and is compared with a lower limit value. In this case, an error signal is output when the lower limit value is undershot. This makes it possible to detect most causes of errors in the sensor and to react in an appropriate manner. In particular, there is no change whatsoever in the diagonal voltage with or without loading in the event of a short circuit of a force sensor inside the Wheatstone bridge. This makes it possible to detect short circuits of the force sensors in an extremely reliable manner. If the force sensor is in series with the loading resistor, this also makes it possible to reliably detect an interruption in the force sensor. In this case too, loading of the Wheatstone bridge does not result in any change in the diagonal voltage over the case without loading. In contrast, if the Wheatstone bridge is fully functional, the bridge symmetry is upset when it is loaded, which results in a change in the diagonal voltage. This change depends only on the ratio of the resistance values of the Wheatstone bridge to the resistance value of the loading resistor and is therefore a known variable.

The value range according to Claim 5 has proved to be suitable for dimensioning the lower limit value of the tensile stress signal. The upper limit of this value range must not be exceeded under any circumstances since otherwise a correctly functioning Wheatstone bridge would be detected as being defective. The lower limit value is specified only for reasons of practicability in order to achieve, in particular, a satisfactory signal-to-noise ratio of the diagonal voltage of the Wheatstone bridge. Otherwise, there would be the risk of a defective Wheatstone bridge being erroneously considered to be functional only on the basis of noise.

In order to be able to reliably detect all possible defects of the Wheatstone bridge, it is advantageous according to Claim 6 if the difference between the tensile stress signal with loading and the tensile stress signal without loading of the Wheatstone bridge is also compared with an upper limit value. An active error signal is likewise output when the upper limit value is exceeded. Further errors which are exhibited by an excessively high level of dependence of the diagonal voltage on the loading can thus be detected. For example, an interruption in that force sensor which is directly loaded can be detected in this manner. This interruption doubles the dependence of the diagonal voltage on the loading, which can be checked in a very simple manner by comparing it with a corresponding limit value. In addition, very unlikely defects, in the case of which both force sensors are simultaneously defective, may be reliably detected in this manner. In the event of both force sensors having a short circuit, the diagonal voltage is zero since the supply voltage of the Wheatstone bridge breaks down in this case. However, if both force sensors have an interruption, an input voltage which is determined only by the amplifier and is generally approximately half the operating voltage is established in the case without loading. However, loading with the resistor pulls the input voltage to earth, thus resulting in a voltage swing of half the operating voltage. This behaviour can also be determined by comparing the tensile stress signals, with and without loading, with an upper limit value.

The dimensions according to Claim 7 have proved to be suitable for the upper limit value in order to be able to reliably detect all conceivable failures inside the Wheatstone bridge.

Loading the Wheatstone bridge deliberately detunes the latter, with the result that the measurement results are correspondingly corrupted. In order to avoid measurement results of the detuned Wheatstone bridge being passed on to downstream components, it is advantageous according to Claim 8 if the sensor outputs tensile stress measured values only for those measuring cycles in which the switch is open. When a plurality of switches are used, it must be ensured in this case that all switches are open. This ensures that measurement results are passed on to downstream components only when the Wheatstone bridge is actually unloaded. Therefore, the measurement results when the Wheatstone bridge is loaded are solely processed internally in order to determine the error signal.

In order to avoid incorrect measurements, it is advantageous according to Claim 9 if the position of the switch is synchronized with the measuring cycles of the sensor. This ensures that the switch position is not changed during the entire measuring cycle, with the result that each measuring cycle is based on a defined switch position.

According to Claim 10, the use of a revision cycle has proved to be suitable for operating the sensor. This revision cycle comprises a plurality of measuring cycles of the sensor and is periodically repeated. In this case, at least one measuring cycle with the switch closed and at least one measuring cycle with the switch open are provided in each revision cycle. Measured values are thus periodically output and the entire sensor is also periodically tested.

When testing both voltage dividers of the Wheatstone bridge, it is favourable according to Claim 11 if at least one measuring cycle with the switch of the first output line of the Wheatstone bridge closed and at least one measuring cycle with the switch of the second output line of the Wheatstone bridge closed are provided in each revision cycle. This ensures that the Wheatstone bridge is tested fully within each revision cycle and at least one measured value for the tensile stress when the Wheatstone bridge is not loaded is also generated.

A short reaction time of the sensor is important, in particular in control engineering applications of the sensor. In this case, the practice of outputting a measured value only for every third measuring cycle often no longer suffices to guarantee clean regulation. In this case, it is favourable according to Claim 12 if more measuring cycles with the switch open than with the switch closed are provided in each revision cycle. Therefore, the sensor essentially generates usable measurement results at the time interval of its cycle time, the sensor being internally tested at particular predefined intervals, with the result that an isolated measuring cycle for generating the tensile stress signal is then omitted. It goes without saying that the measured value generated last can be stored and can also be provided to the downstream components in order to bridge this omission.

In order to regulate the web tension, it is favourable according to Claim 13 if the tensile stress signal output by the sensor is used as an actual value during regulation. In contrast, the regulating operation is blocked in the case of an active error signal in order to prevent undefined or even destructive reactions of the regulating operation.

Loading the Wheatstone bridge results in an additional voltage swing in the diagonal voltage which must be managed by a downstream amplifier and, if appropriate, an analogue/digital converter. This results, in principle, in the analogue/digital converter using part of its bit width for the loading test. This is generally not important when the Wheatstone bridge is slightly loaded. However, it results in the functionality test of the Wheatstone bridge being susceptible to interference to a relatively great extent. If the entire dynamic range of the amplifier and of the analogue/digital converter is desired to be used for a high level of meaningfulness of the functional test, it is favourable according to Claim 14 if the supply voltage of the Wheatstone bridge is also changed when the latter is loaded. The change in the supply voltage is generally selected in this case in such a manner that it counteracts the effect of the loading. The supply voltage is preferably selected in the cases with and without loading in such a manner that approximately the same diagonal voltage occurs in the case of a functional Wheatstone bridge. The entire dynamic range of the amplifier and of the analogue/digital converter can thus be used for the measuring task. A defect in the Wheatstone bridge results in this case in a change in the diagonal voltage which can be detected by the analogue/digital converter. As a result, the latter possibly changes to an overflow condition which can be detected in a very simple manner. There is no need to exactly measure the voltage swing in this case since only the functionality in the form of a yes/no decision is required for this purpose.

In order to achieve a particularly reliable system, it is advantageous according to Claim 15 if at least two Wheatstone bridges are provided. These Wheatstone bridges each provide diagonal voltages which are evaluated using amplifiers and analogue/digital converters. In this case, both Wheatstone bridges are monitored in the manner described above. In the event of the occurrence of an error signal for one of the Wheatstone bridges, the other Wheatstone bridge generates the tensile stress signal. The same principle can also be implemented with more than two Wheatstone bridges. In this case, the individual Wheatstone bridges are preferably prioritized or their tensile stress signal is averaged in order to achieve better accuracy. Wheatstone bridges which exhibit an active error signal are precluded from the calculation in this case.

The subject matter of the invention is explained by way of example using the drawing, without restricting the scope of protection.

Further advantages and features of the present invention are presented in the following detailed description with reference to the accompanying figure which contains an exemplary embodiment of the present invention. It should be understood, however, that the drawing serves merely for the purpose of illustrating the invention and does not restrict the scope of protection of the invention.

Figure 2:
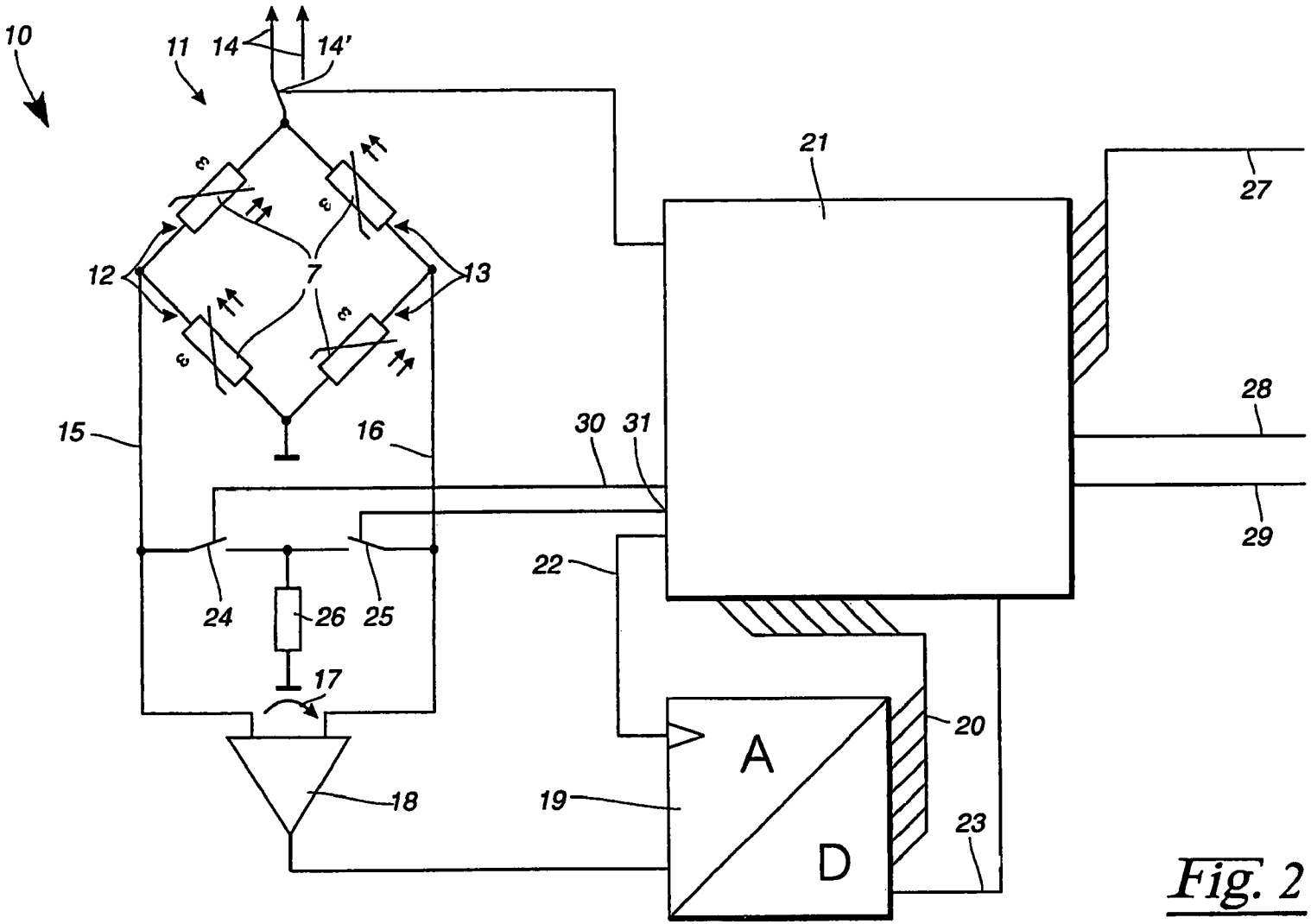
Figure 3:
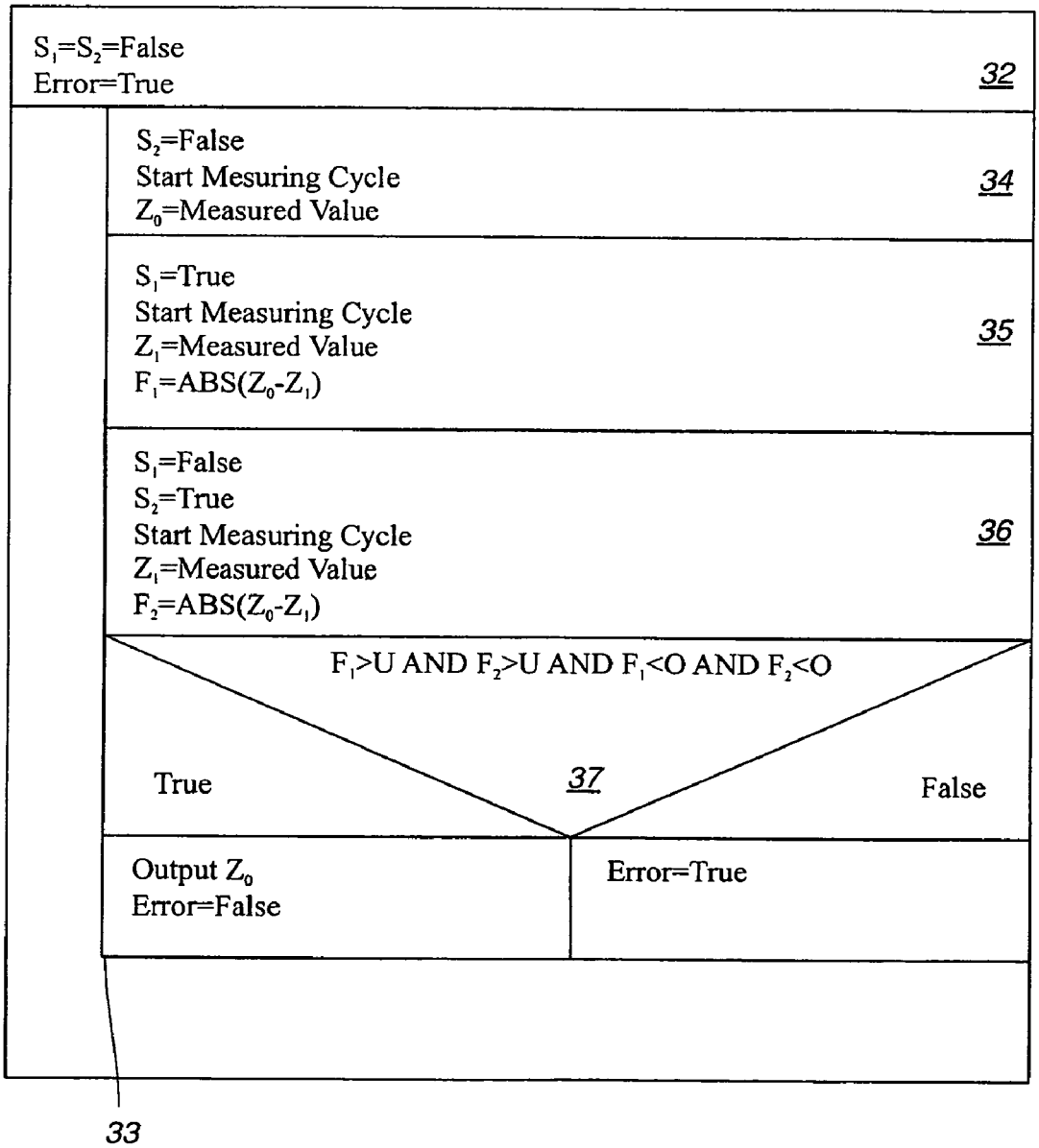

In the drawing:

FIG. 1 shows a sectional illustration through a force measuring roll of a running material web, FIG. 2 shows a schematic illustration of a sensor, and FIG. 3 shows a flowchart for operating the sensor according to FIG. 2.

FIG. 1 shows a sectional illustration through a force measuring roll 1 at which a material web 2 is deflected. In this case, the material web 2 exerts a force 3 on the force measuring roll 1 which depends only on the tensile stress of the material web 2 and on the wrap angle around the force measuring roll 1. Therefore, in order to measure the tensile stress of the material web 2, it suffices to measure the bearing force of the force measuring roll 1 with a known wrap angle.

The force measuring roll 1 has a stationary body 4 which is connected to a machine-mounted shaft 6 by means of double bending bars 5. The double bending bars 5 are deformed in the shape of an S to a greater or lesser extent depending on the loading of the force measuring roll 1 by the force 3. Force sensors 7 which are preferably formed by strain gauges are fitted to the double bending bars 5. These force sensors are essentially non-reactive resistors which change their resistance value when bent. In this case, the force sensors 7 are fitted in the end regions of the double bending bars 5 where the curvature of the double bending bars 5 is greatest. The stationary body 4 is connected, by means of a rolling bearing 8, to a shell 9 which forms the outer contour of the force measuring roll 1. This shell 9 is directly detected by the material web 2.

FIG. 2 shows a basic circuit diagram of a sensor 10 which detects the bearing force of the force measuring roll 1 and thus indirectly detects the tensile stress of the material web 2. The sensor 10 has a Wheatstone bridge 11 formed by two voltage dividers 12, 13. In this case, the voltage dividers 12, 13 are formed by the force sensors 7 which are fitted to the double bending bars 5. The use of four force sensors 7 which are connected to form the Wheatstone bridge 11 results in advantageous temperature compensation of the force sensors 7. In addition, this essentially eliminates the drift of the force sensors 7.

The Wheatstone bridge 11 is selectively supplied, by means of a changeover switch 14', with a supply voltage 14 which is stable and has low noise. Two output lines 15, 16, between which a diagonal voltage 17 is dropped, lead away from the Wheatstone bridge 11. This diagonal voltage 17 is the actual measurement signal which is obtained from the force sensors 7. The output lines 15, 16 are supplied to an amplifier 18 which is in the form of a differential amplifier. The amplifier 18 has high-impedance inputs in order to avoid loading the Wheatstone bridge 11 as far as possible. In addition, the amplifier 18 can amplify the diagonal voltage 17 by a gain factor which makes it possible to evaluate the diagonal voltage 17 in a simple manner.

The output of the amplifier 18 is operatively connected to an analogue/digital converter 19 which uses the output signal from the amplifier 18 to generate a digital word which is proportional to said output signal. This digital word is supplied, by means of a bus 20, to a processor 21 in which it is processed. The processor 21 may use a control line 22 to trigger a measuring cycle in the analogue/digital converter 19. As a response, the processor 21 receives, via a signal line 23, the information that the measuring cycle of the analogue/digital converter 19 has been concluded and a new data word is thus present on the bus 20.

In order to be able to determine whether the force sensors 7 are still functional and the Wheatstone bridge 11 thus emits meaningful values, the two output lines 16, 17 can be loaded with a loading resistor 26 by means of switches 24, 25. This loading resistor 26 ensures that one side of the Wheatstone bridge 11 is detuned, so that a defined change in the diagonal voltage 17 can be expected. The bus 20 is used to supply this change in the diagonal voltage 17, via the amplifier 18 and the analogue/digital converter 19, to the processor 21 which applies appropriate mathematical operations to this data word. In this case, an error signal 28 is output in addition to a tensile stress signal 27 which essentially corresponds to the value on the bus 20 when the Wheatstone bridge 11 is not loaded. In the activated state, this error signal 28 indicates that the Wheatstone bridge 11 is defective and the tensile stress signal 27 which has been output therefore cannot be used. In addition, the processor 21 passes a handshake signal 29 to the downstream components in order to synchronize them with the data output of the processor 21.

In order to drive the two switches 24, 25, the processor 21 has two control outputs 30, 31 which ensure that the switches 24, 25 are closed only during a test cycle, the switches 24, 25 not being closed simultaneously but only alternately. The two switches 24, 25 are open during a normal measuring operation in which a new tensile stress signal 27 is intended to be determined.

In addition, the processor 21 can also change over the supply voltage 14 of the Wheatstone bridge 11 for the duration of the test cycle. This changeover gives rise to a proportional change in the diagonal voltage 17, with the result that the voltage swing caused by the loading becomes smaller. It is also conceivable to change the supply voltage of the Wheatstone bridge 11 in such a manner that it exactly counteracts the loading. In this case, there is no loading-dependent change in the diagonal voltage 17 if the Wheatstone bridge 11 is functional. However, if the Wheatstone bridge 11 is defective, a characteristic voltage swing of the diagonal voltage 17 results in this case.

FIG. 3 shows a flowchart for operating the processor 21. In an initialization step 32, the two switches 24, are opened and the error signal 28 is activated. This prevents a numerical value which is accidentally applied to the output 28 being interpreted as a measured value.

A loop which defines a revision cycle 33 follows the initialization step 32. This revision cycle 33 is therefore periodically repeated as often as desired following initialization 32.

In the revision cycle 33, the switch 25 is first of all opened and a measuring cycle 34 is started. In this case, the measurement is carried out when the Wheatstone bridge 11 is not loaded. The data value obtained from the measuring cycle is stored in a variable $Z_0$. As an alternative to FIG. 3, a plurality of measuring cycles 34 could also be started in succession and the measurement results could be output if the error signal 28 is deactivated.

The switch 24 is then closed, as a result of which the output line 15 of the Wheatstone bridge 11 is loaded by the loading resistor 26. A new measuring cycle 35 is then started and the measured value of the analogue/digital converter 19 which is determined in the process is stored in a variable $Z_1$. The absolute magnitude of the difference between the values $Z_0$ and $Z_1$ is then calculated and stored in a variable $F_1$. As an alternative to FIG. 3, a plurality of measuring cycles 34 with the switches 24, 25 open could now follow, the measurement results of which are output only if the error signal is deactivated.

In the subsequent step, the positions of the two switches 24, 25 are interchanged, with the result that the output line 16 of the Wheatstone bridge 11 is now loaded by the loading resistor 26. A further measuring cycle 36 is then started. The value determined by the analogue/digital converter 19 is again stored in the variable $Z_1$. The absolute magnitude of the difference between the variables $Z_0$ and $Z_1$ is now determined again and stored in a variable $F_2$. The variables $F_1$ and $F_2$ therefore contain measures of the extent to which the Wheatstone bridge 11 is influenced by the two types of loading used.

In a subsequent comparison step 37, the variables $F_1$ and $F_2$ are compared with predefined lower threshold values U and upper threshold values O. The sensor 10 is interpreted as being functional and the value $Z_0$ is output only when both variables $F_1$ and $F_2$ are inside the band defined by the threshold values U and O. The value $Z_0$ contains the measured value for the case in which the Wheatstone bridge 11 is not loaded. In addition, the error signal 28 is reset in this case in order to indicate to downstream components that the measured value which has been output is reliable.

Since some exemplary embodiments of the present invention are not shown or described, it must be understood that a multiplicity of changes and modifications of this exemplary embodiment described are possible, without departing from the essential idea and scope of protection of the invention defined by the claims.

LIST OF REFERENCE SYMBOLS

1 Force measuring roll
2 Material web
3 Force
4 Stationary body
5 Double bending bar
6 Shaft
7 Force sensor
8 Rolling bearing
9 Shell
10 Sensor
11 Wheatstone bridge
12 Voltage divider
13 Voltage divider
14 Supply voltage
14' Changeover switch
15 Output line
16 Output line
17 Diagonal voltage
18 Amplifier
19 Analogue/digital converter
20 Bus
21 Processor
22 Control line
23 Control line
24 Switch
25 Switch
26 Loading resistor
27 Tensile stress signal
28 Error signal
29 Handshake signal
30 Control output
31 Control output
32 Initialization step
33 Revision cycle
34 Measuring cycle without loading
35 Measuring cycle with loading
36 Measuring cycle with loading
37 Comparison step

The invention claimed is:

1. Method for measuring the tensile stress of a running web (2) using at least one sensor (10) which has at least one Wheatstone bridge (11) containing at least one force sensor (7) which is influenced by the tensile stress of the running web (2), a diagonal voltage (17) of the at least one Wheatstone bridge (11) being amplified by an amplifier (18) which outputs a tensile stress signal ($Z_0$), characterized in that the at least one Wheatstone bridge (11) is periodically loaded by at least one resistor (26) using at least one intermittently driven switch (24, 25) during loading by the tensile stress of the running web (2), the functionality of the at least one sensor (10) being determined from the extent to which the tensile stress signal ($Z_1$) is influenced by the loading and being output in the form of an error signal (28).

2. Method according to claim 1, characterized in that both output lines (15, 16) of the Wheatstone bridge (11) are loaded with at least one resistor (26) by means of at least one switch (24, 25).

3. Method according to claim 2, characterized in that the output lines (15, 16) of the Wheatstone bridge (11) are alternately loaded by the at least one resistor (26).

4. Method according to at least one of claims 1 to 3, characterized in that the difference ($F_1$, $F_2$) between the tensile stress signals ($Z_0$, $Z_1$) with and without loading of the Wheatstone bridge (11) is calculated and is compared with a lower limit value (U), an active error signal (28) being output when said lower limit value is undershot.

5. Method according to claim 4, characterized in that the lower limit value (U) is between 0.05 and 0.5 times the value $$\frac{U_W V R_K}{R_K + R_S}$$

where $U_w$ is the supply voltage of the Wheatstone bridge (11), V is the gain factor, $R_S$ is the loading resistance and $R_K$ is the resistance of the force sensor (7).

6. Method according to claim 4 or 5, characterized in that the difference ($F_1$, $F_2$) is compared with an upper limit value (O), an active error signal (28) being output when said upper limit value is exceeded.

7. Method according to claim 6, characterized in that the upper limit value (O) is less than 0.5 $U_W$ and less than $$\frac{U_W V R_K}{R_K + R_S}$$

where $U_W$ is the supply voltage of the Wheatstone bridge (11), V is the gain factor, $R_S$ is the loading resistance (26) and $R_K$ is the resistance of the force sensor (7).

8. Method according to at least one of claims 1 to 7, characterized in that the sensor (10) outputs tensile stress measured values ($Z_0$) only for those measuring cycles (34) in which the at least one switch (24, 25) is open.

9. Method according to at least one of claims 1 to 8, characterized in that the position of the at least one switch (24, 25) is synchronized with the measuring cycles (34, 35, 36) of the sensor (10).

10. Method according to claim 9, characterized in that provision is made of a revision cycle (33) which comprises a plurality of measuring cycles (34, 35, 36) of the sensor (10), at least one measuring cycle (35, 36) with the switch (24, 25) closed and at least one measuring cycle (34) with the switch (24, 25) open being provided in each revision cycle (33).

11. Method according to claim 10, characterized in that at least one measuring cycle (35) with the switch (24) of the first output line (15) of the Wheatstone bridge closed and at least one measuring cycle (36) with the switch (25) of the second output line (16) of the Wheatstone bridge (11) closed are provided in each revision cycle (33).

12. Method according to claim 10 or 11, characterized in that more measuring cycles (34) with the switch (24, 25) open than with the switch (24, 25) closed are provided in each revision cycle (33).

13. Method according to at least one of claims 1 to 12, characterized in that the web tension is regulated, the tensile stress signal (27) output by the sensor (10) being used as an actual value, the regulating operation being blocked in the case of an active error signal (28).

14. Method according to at least one of claims 1 to 13, characterized in that the supply voltage (14) of the Wheatstone bridge (11) is also changed when the latter is loaded.

15. Method according to at least one of claims 1 to 14, characterized in that at least two of the Wheatstone bridges (11) are provided, in which case, in the event of an error signal (28) for one of the Wheatstone bridges (11), at least one of the other Wheatstone bridges (11) generates the tensile stress signal ($Z_0$).

* * * * *